US007490036B2

(12) United States Patent
Jasiuk et al.

(10) Patent No.: US 7,490,036 B2
(45) Date of Patent: Feb. 10, 2009

(54) ADAPTIVE EQUALIZER FOR A CODED SPEECH SIGNAL

(75) Inventors: Mark A. Jasiuk, Chicago, IL (US); Tenkasi V. Ramabadran, Naperville, IL (US)

(73) Assignee: Motorola, Inc., Schaumburg, IL (US)

( * ) Notice: Subject to any disclaimer, the term of this patent is extended or adjusted under 35 U.S.C. 154(b) by 560 days.

(21) Appl. No.: 11/254,823

(22) Filed: Oct. 20, 2005

(65) Prior Publication Data

US 2007/0094016 A1 Apr. 26, 2007

(51) Int. Cl.
*G10L 19/04* (2006.01)

(52) U.S. Cl. ..... 704/219; 704/220; 704/221

(58) Field of Classification Search ..... 704/219, 704/220, 221

See application file for complete search history.

(56) References Cited

U.S. PATENT DOCUMENTS

| | | | | |
|---|---|---|---|---|
| 6,611,798 | B2 * | 8/2003 | Bruhn et al. | 704/219 |
| 6,668,161 | B2 * | 12/2003 | Boros et al. | 455/67.14 |
| 2004/0172241 | A1 * | 9/2004 | Mahe et al. | 704/205 |
| 2005/0137863 | A1 * | 6/2005 | Jasiuk et al. | 704/222 |
| 2006/0045281 | A1 * | 3/2006 | Korneluk et al. | 381/60 |

FOREIGN PATENT DOCUMENTS

EP 1 141 946 B1 4/2004

OTHER PUBLICATIONS

Ramachandran, Ravi P. et al.: "Pitch Prediction Filters in Speech Coding", IEE Transaction of Acoustics, Speech and Signal Processing, vol. 37, No. 4, Apr. 1989, pp. 467-478.

Atal, Bishnu S.: "Predictive Coding of Speech at Low Bit Rates", IEEE Transactions on Communications, vol. COM-30, No. 4, Apr. 1982, pp. 600-614.

Chen, Juin-Hwey et al.: "Real-Time Vector APC Speech Coding at 4800BPS with Adaptive Postfiltering", CH2396-0/87/0000-2185, © 1987 IEEE, 51.3.1, pp. 2185-2188.

ETSI EN 300 726 v8.0.1 (Nov. 2000), European Standard (Telecommunications series), Digital cellular telecommunications system (Phase 2+); Enhanced Full Rate (EFR) speech transcoding; (GSM 06.60 version 8.0.1 Release 1999), GSM, Global System For Mobile Communications, pp. 1-43.

3GPP2 C.S0052-A, Version 1.0, Date: Apr. 22, 2005, 3G: 3rd Generation Partnership Project 2 "3GPP2", "Source-Controlled Variable-Rate Multimode Wideband Speech Codec(VMR-WB), Service Options 62 and 63 for Spread Spectrum Systems", pp. 1-164.

* cited by examiner

*Primary Examiner*—Qi Han

(57) ABSTRACT

A speech communication system provides a speech encoder that generates a set of coded parameters representative of the desired speech signal characteristics. The speech communication system also provides a speech decoder that receives the set of coded parameters to generate reconstructed speech. The speech decoder includes an equalizer that computes a matching set of parameters from the reconstructed speech generated by the speech decoder, undoes the set of characteristics corresponding to the computed set of parameters, and imposes the set of characteristics corresponding to the coded set of parameters, thereby producing equalized reconstructed speech.

23 Claims, 11 Drawing Sheets

- PRIOR ART -

500

ADAPTIVE EQUALIZER FOR A CODED SPEECH SIGNAL

FIELD

This invention relates to communication systems, and more particularly, to the enhancement of speech quality in a communication system.

BACKGROUND

One of the characteristics of Analysis-by-Synthesis (A-by-S) speech coders, that typically use the Mean Square Error (MSE) minimization criterion, is that as the bit rate is reduced, the error matching at higher frequencies becomes less efficient and consequently MSE tends to emphasize signal modeling at lower frequencies. The training procedure for optimizing excitation codebooks, when used, likewise tends to emphasize lower frequencies and attenuate higher frequencies in the trained codevectors, with the effect becoming more pronounced as the excitation codebook size is decreased. The perceived effect of the above on reconstructed speech is that it becomes increasingly muffled with bit rate reduction. One solution to this problem is described in the 3GPP2 Document "Source-Controlled Variable-Rate Multimode Wideband Speech Codec (VMR-WB) Service Options 62 and 63 for Spread Spectrum Systems," in the context of an algebraic excitation codebook. The solution involves the use of a shaping filter formulated as a preemphasis filter for the excitation codebook, described by:

$$H_{FCB_shape}(z)=1-\mu z^{-1},\ 0\leqq\mu\leqq 0.5$$

where μ is selected based on the degree of periodicity at the previous subframe, which, when high, causes a value of μ close to 0.5 to be selected. This imposes a high-pass characteristic on the excitation codebook vector being evaluated, and thereby the excitation codebook vector that is ultimately selected. The MSE criterion is used to select a vector from the excitation codebook which has been adaptively shaped as described.

While the above technique does mitigate, to a degree, the attenuation of high frequencies in the coded signal, it does not necessarily optimize the MSE criterion. However, the resulting reconstructed speech sounds more similar to the target input speech, which is why the shaping is employed despite its effect on MSE.

In the European Patent EP 1 141 946 B1,titled "Coded Enhancement Feature for Improved Performance in a Coding Communication Signals", Hagen and Kleijn propose a method for reducing the distance between the target signal and the coded signal. They compute in the frequency domain, a transfer function which when applied to the reconstructed signal, results in the reconstructed signal exactly matching the input signal. In practice, this transfer function is simplified (as explained in EP 1 141 946 B1), prior to being explicitly quantized, so as to reduce the amount of information in need of quantization, and is then conveyed from the encoder to the decoder via a communication channel. The simplification, followed by quantization, of the transfer function prevents exact signal reconstruction from being achieved. The quantized transfer function constitutes the encoded enhancement information, and is explicitly transmitted. This points to one drawback of EP 1 141 946 B1 when applied to the task of enhancing the performance of a selected speech coder. Since the enhancement information is explicitly modeled as a transfer function between the input target signal and the reconstructed (coded) signal, it needs to be potentially simplified, then explicitly quantized, and conveyed to the decoder, because input speech typically is not available at the decoder. Consequently this approach incurs a cost in bandwidth, for providing the enhancement information to the decoder.

BRIEF DESCRIPTION OF THE DRAWINGS

While this invention is susceptible of embodiment in many different forms, there is shown in the drawings and will herein be described in detail one or more specific embodiments, with the understanding that the present disclosure is to be considered as exemplary of the principles of the invention and not intended to limit the invention to the specific embodiments shown and described. In the description, like reference numerals are used to describe the same, similar or corresponding parts in the several views of the drawings.

DETAILED DESCRIPTION

Figure 1:
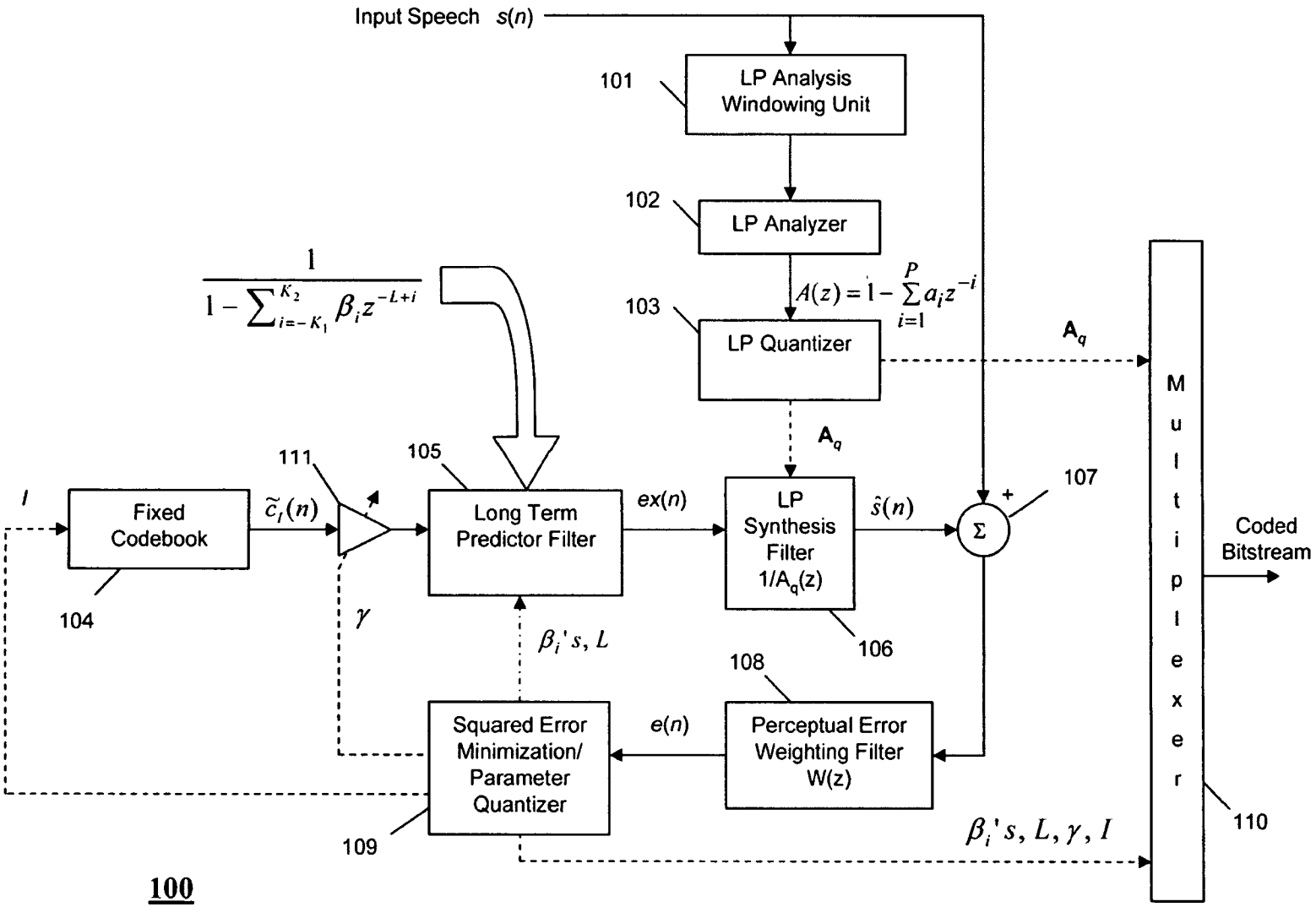
FIG. 1 is a block diagram of a code excited linear predictive speech encoder.

While this invention is susceptible of embodiment in many different forms, there is shown in the drawings and will herein be described in detail one or more specific embodiments, with the understanding that the present disclosure is to be considered as exemplary of the principles of the invention and not intended to limit the invention to the specific embodiments shown and described. In the description below, like reference numerals are used to describe the same, similar or corresponding parts in the several views of the drawings.

Another approach to preserving in the reconstructed speech the overall frequency characteristics of the source input speech, has been formulated and implemented. The idea is to design an equalizer which would bridge the gap between a set of characteristics calculated and coded from the input speech, and a similar set of characteristics computed from the reconstructed speech. Such an equalizer is then applied to the reconstructed speech to:

Undo the set of characteristics computed from the reconstructed speech and

Impose onto the reconstructed speech the set of coded characteristics of the input speech.

The set of coded characteristics that has been selected in this embodiment is the set of short-term Linear Predictor (LP)

filter coefficients. Other sets of coded characteristics, such as long-term predictor (LTP) filter parameters, energy, etc., can also be selected and used either individually or in combination with one another, for equalizing the reconstructed speech, as can be appreciated by those skilled in the art.

Note that the present invention does not require the speech encoder to convey to the speech decoder any quantized information about the equalizer response. Instead the equalizer response is derived at the speech decoder, based on the selected speech coder parameters that were quantized by the speech encoder and transmitted, and a matching set of parameters computed at the speech decoder from the reconstructed speech. The equalizer so derived is then applied to the reconstructed speech to obtain the equalized reconstructed speech, which is perceptually closer to the input speech than the reconstructed speech. Since the present invention does not require explicit quantization and transmission of information about the equalizer response, it may be used to enhance the performance of existing speech coder systems, the design of which did not envision use of such an equalizer. However, to best harness the speech quality improvement potential, the design of a speech encoder should take into account the use of an equalizer at the speech decoder, as will be described below.

This implementation of the present invention utilizes an overlap-add signal analysis/synthesis technique that uses analysis windows allowing perfect signal reconstruction. Here perfect signal reconstruction means that the overlapping portions of the analysis windows at any given sample index sum up to 1 and windowed samples that are not overlapped are passed through unchanged (i.e., unity gain is assumed). The advantage of using the overlap-add type analysis/synthesis is that discontinuities, that may potentially be introduced at the equalization block, are smoothed by averaging the samples in the overlap region. It is also possible to use non-overlapping, contiguous analysis windows, but in that case special care must be taken so that no discontinuities in the equalized signal are introduced at the window boundaries. A 256 sample (assuming 8 kHz sampling rate) raised cosine analysis window with 50% overlap is used. It is also assumed that the windowing of the input speech and the windowing of the reconstructed speech are done synchronously, and sequentially. That is, the decoded speech is assumed to be phase aligned relative to the input speech which was encoded, with the same type of analysis window being used at the speech encoder and the speech decoder. It will be appreciated that the reconstructed speech becomes available after a delay due to processing and framing. Note that two windowing operations are involved for processing the reconstructed speech: one for linear prediction (LP) analysis and the other for overlap-add analysis/synthesis. When it is necessary to distinguish between the two windows, the former window is referred to as LP analysis window and the latter as synthesis window. In this embodiment, these two windows are the same. Note also that while the LP analysis window used for analyzing the reconstructed speech in the present invention is identical to the LP analysis window used at the speech encoder, those two windows need not be the same.

The speech coding algorithm utilized by the speech encoder in accordance with certain embodiments of the present invention belongs to an A-by-S family of speech coding algorithms. The technique disclosed herein can also be beneficially applied to other types of speech coding algorithms for which the set of characteristics of the synthesized speech diverges from the set of characteristics computed from the input speech. One type of an A-by-S speech coder used for low rate coding applications typically employs techniques such as Linear Predictive Coding (LPC) to model the spectra of short-term speech signals. Coding systems employing the LPC technique provide prediction residual signals for corrections to characteristics of a short-term model. An example of such a coding system is a speech coding system known as Code Excited Linear Prediction (CELP) that produces high quality synthesized speech at low bit rates, that is, at bit rates of 4.8 to 9.6 kilobits-per-second (kbps). This class of speech coding, also known as vector-excited linear prediction or stochastic coding, is used in numerous speech communications and speech synthesis applications. CELP is also particularly applicable to digital speech encryption and digital radiotelephone communication systems wherein speech quality, data rate, size, and cost are significant issues.

A CELP speech coder that implements the LPC coding technique typically employs long-term (pitch) and short-term (formant) predictors to model the characteristics of an input speech signal. The long-term (pitch) and short-term (formant) predictors are incorporated into a set of time-varying linear filters. An excitation signal, or codevector, for the filters is chosen from a codebook of stored codevectors. For each frame of speech, the speech coder applies the chosen codevector to the filters to generate a reconstructed speech signal, and compares the original input speech signal to the reconstructed speech signal to create an error signal. The error signal is then weighted by passing it through a perceptual weighting filter having a response based on human auditory perception. An optimum excitation signal is then determined by selecting one or more codevectors that produce a weighted error signal with minimum energy for the current frame. Typically the frame is partitioned into two or more contiguous subframes. The short-term predictor parameters are usually determined once per frame and are updated at each subframe by interpolating between the short-term predictor parameters of the current frame and the previous frame. The analysis window used for the determination of the short-term parameters satisfies the property of overlap-add windowing which allows perfect signal reconstruction, as described above. The excitation signal parameters are typically determined for each subframe.

FIG. 1 is an electrical block diagram of a code excited linear predictive (CELP) speech encoder 100. In the CELP speech encoder 100, an input signal s(n) is windowed using a linear predictive (LP) analysis windowing unit 101, with the windowed signal then applied to the LP analyzer 102, where linear predictive coding is used to estimate the short-term spectral envelope. The resulting spectral coefficients ,or linear prediction (LP) coefficients, are used to define the transfer function A(z) of order P, corresponding to an LP zero filter or, equivalently, an LP inverse filter:

$$A(z) = 1 - \sum_{i=1}^{P} a_i z^{-i}$$

The spectral coefficients are applied to an LP quantizer 103 to produce quantized spectral coefficients $A_q$. The quantized spectral coefficients $A_q$ are then provided to a multiplexer 110 that produces a coded bitstream based on the quantized spectral coefficients $A_q$ and a set of excitation vector-related parameters L, $\beta_i$'s, I, and $\gamma$, that are determined by a squared error minimization/parameter quantizer 109. The set of excitation vector-related parameters includes the long-term predictor (LTP) parameters (lag L and predictor coefficients $\beta_i$'s), and the fixed codebook parameters (index I and scale factor $\gamma$).

The quantized spectral coefficients $A_q$ are also provided locally to an LP synthesis filter 106 that has a corresponding transfer function $1/A_q(z)$. Note that for the case of multiple subframes in a frame, the LP synthesis filter 106 is typically $1/A_q(z)$ at the last subframe of the frame, and is derived from $A_q$ of the current and previous frames, for example, by interpolation at the other subframes of the frame. The LP synthesis filter 106 also receives a combined excitation signal ex(n) and produces an input signal estimate ŝ(n) based on the quantized spectral coefficients $A_q$ and the combined excitation signal ex(n). The combined excitation signal ex(n) is produced as described below. A fixed codebook (FCB) codevector, or excitation vector, $\tilde{c}_I$ is selected from a fixed codebook 104 based on a fixed codebook index parameter I. The FCB codevector $\tilde{c}_I$ is then scaled by gain controller 111 based on the gain parameter γ and the scaled fixed codebook codevector is provided to a long-term predictor (LTP) filter 105. The LTP filter 105 has a corresponding transfer function $$\frac{1}{\left(1-\sum_{i=-K_1}^{K_2}\beta_i z^{-L+i}\right)},\ K_1 \geq 0,\ K_2 \geq 0,\ K = 1 + K_1 + K_2 \tag{1}$$

where K is the LTP filter order (typically between 1 and 3, inclusive) and $\beta_i$'s and L are excitation vector-related parameters that are provided to the long-term predictor filter 105 by a squared error minimization/parameter quantizer 109. In the above definition of the LTP filter transfer function, L specifies the delay value in number of samples. This form of LTP filter transfer function is described in a paper by Bishnu S. Atal, "Predictive Coding of Speech at Low Bit Rates," IEEE Transactions on Communications, VOL. COM-30,NO. 4,April 1982,pp. 600-614 (hereafter referred to as Atal) and in a paper by Ravi P. Ramachandran and Peter Kabal, "Pitch Prediction Filters in Speech Coding," IEEE Transactions on Acoustics, Speech, and Signal Processing, VOL. 37,NO. 4,April 1989, pp. 467-478 (hereafter referred to as Ramachandran et. al.). The long-term predictor (LTP) filter 105 filters the scaled fixed codebook codevector received from fixed codebook 104 to produce the combined excitation signal ex(n) and provides the combined excitation signal ex(n) to the LP synthesis filter 106.

The LP synthesis filter 106 provides the input signal estimate ŝ(n) to a combiner 107. The combiner 107 also receives the input signal s(n) and subtracts the input signal estimate ŝ(n) from the input signal s(n). The difference between input signal s(n) and input signal estimate ŝ(n), called the error signal, is provided to a perceptual error weighting filter 108, that produces a perceptually weighted error signal e(n) based on the error signal and a weighting function W(z). Perceptually weighted error signal e(n) is then provided to the squared error minimization/parameter quantizer 109. The squared error minimization/parameter quantizer 109 uses the weighted error signal e(n) to determine an error value E $$\left(\text{typically } E = \sum_{n=0}^{N-1} e^2(n)\right),$$

and subsequently, an optimal set of excitation vector-related parameters L, $\beta_i$'s, I, and γ that produce the best input signal estimate ŝ(n) for the input signal s(n) based on the minimization of E, typically over N samples, where N is the number of samples in a subframe.

In a CELP speech coder such as CELP speech encoder 100, a synthesis function for generating the combined excitation signal ex(n) is given by the following generalized difference equation:

$$ex(n) = \gamma\tilde{c}_I(n) + \sum_{i=-K_1}^{K_2}\beta_i ex(n-L+i),\quad n = 0, \ldots, N-1,\quad K_1 \geq 0,\ K_2 \geq 0, \tag{1a}$$

where ex(n) is a synthetic combined excitation signal for a subframe, $\tilde{c}_I$, (n) is a codevector, or excitation vector, selected from a codebook, such as the fixed codebook 104, I is an index parameter, or codeword, specifying the selected codevector, γ is the gain for scaling the codevector, ex(n−L+i) is a combined excitation signal delayed by (n+i)-th samples relative to the (n+i)-th sample of the current subframe (for voiced speech L is typically related to the pitch period), $\beta_i$'s are the long-term predictor (LTP) filter coefficients. When n−L+i<0, ex(n−L+i) includes the history of past combined excitation, constructed as shown in eqn. 1a. That is, for n−L+i<0,the expression 'ex(n−L+i)' corresponds to an combined excitation sample constructed prior to the current subframe, which combined excitation sample has been delayed and scaled pursuant to an LTP filter transfer function $$\frac{1}{1-\sum_{i=-K_1}^{K_2}\beta_i z^{-L+i}},\ K_1 \geq 0,\ K_2 \geq 0,\ K = 1 + K_1 + K_2 \tag{2}$$

The task of a typical CELP speech coder, such as CELP speech encoder 100, is to select the parameters specifying the combined excitation, that is, the parameters L, $\beta_i$'s, I, γ in the speech encoder 100, given ex(n) for n<0 and the determined coefficients of the LP synthesis filter 106. When the combined excitation signal ex(n) for 0≦n<N is filtered through the LP synthesis filter 106, the resulting input signal estimate ŝ(n) most closely approximates, according to a distortion criterion employed, the input speech signal s(n) to be coded for that subframe. In the speech encoder 100 in accordance with embodiments of the present invention, the sampling frequency is 8 kHz, the subframe length N is 64,the number of subframes per frame is 2,the LP filter order P is 10,and the LP analysis window length is 256 samples, with the LP analysis window centered about the $2^{nd}$ subframe of the frame. The LP analysis windowing unit 101 utilizes a raised cosine widow that is identical to the analysis window used by the equalizer at the speech decoder (as will be described below) and permits overlap/add synthesis with perfect signal reconstruction at the speech decoder. Note that while a specific example of a speech encoder was given, other speech coder configurations can also be beneficially utilized. For example, different values of sampling frequency, subframe length N, number of subframes per frame, LP filter order P, and LP analysis window length can be employed. Note also that an LP analysis window other than raised cosine window can be used, and that the LP analysis window used at the speech encoder and the equalizer need not be the same. Furthermore, the LP analysis window used at the equalizer need not be the same as the window used for the overlap-add operation at the equalizer. For example, the LP analysis window at the equalizer need not satisfy the perfect reconstruction property while the window used for the overlap-add operation preferably satisfies the perfect reconstruction property.

The speech coder parameters selected by the speech encoder 100—the quantized LP coefficients and the optimal set of parameters L, $\beta_i$'s, I, and $\gamma$—are then converted in the multiplexer 110 to a coded bitstream, which is transmitted over a communication channel to a communication receiving device, which receives the parameters for use by the speech decoder. An alternate use may involve efficient storage to an electronic or electromechanical device, such as a computer hard disk, where the coded bitstream is stored, prior to being demultiplexed and decoded for use by a speech synthesizer. At the speech decoder, the speech synthesizer uses quantized LP coefficients and excitation vector-related parameters to reconstruct the estimate of the input speech signal $\hat{s}(n)$.

The CELP speech encoder 100 can be implemented using custom integrated circuits, FPGAs, PLAs, microcomputers with corresponding embedded firmware, microprocessor with preprogrammed ROMs or PROMs, and digital signal processors. Other types of custom integration can be utilized as well. The CELP speech encoder 100 can also be implemented using computers, including but not limited to, desk top computers, laptop computers, servers, computer clusters, and the like. When implemented as custom integrated circuits, the CELP speech encoder can be utilized in communication devices such as cell phones.

Figure 2:
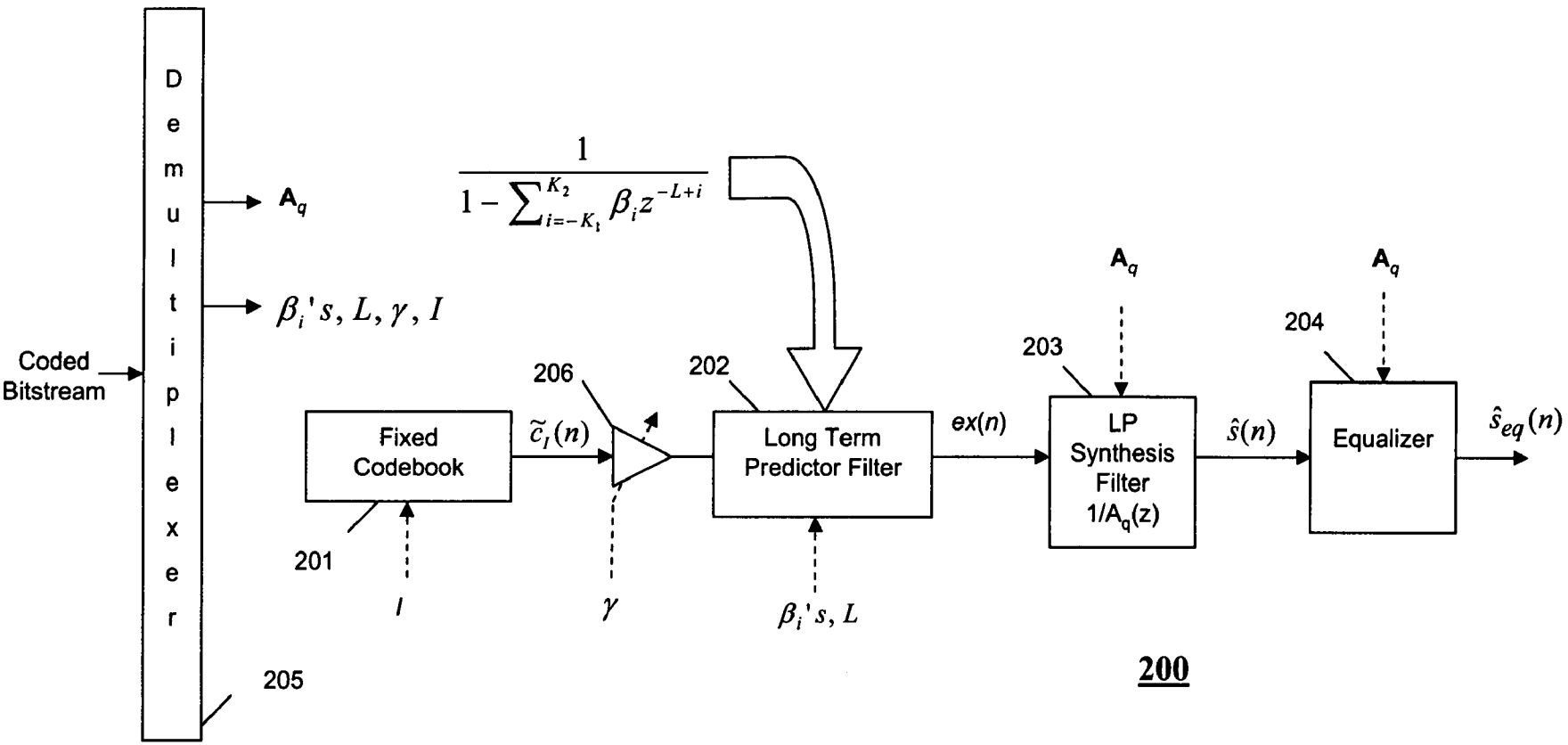
FIG. 2 is a block diagram of a code excited linear predictive speech decoder that incorporates equalizer block 204.

FIG. 2 is a block diagram of the speech decoder 200. The coded bitstream which is received over the communication channel (or from the storage device), is input to a demultiplexer block 205, which demultiplexes the coded bitstream and decodes the excitation related parameters L, $\beta_i$'s, I, and $\gamma$ and the quantized LP filter coefficients $A_q$. The fixed codebook index I is applied to a fixed codebook 201, and in response an excitation vector $\tilde{c}_I(n)$ is generated. The gain controller 206 multiplies the excitation vector $\tilde{c}_I(n)$ by the scale factor y to form the input to a long-term predictor filter 202, which is defined by parameters L and $\beta_i$'s. The output of the long-term predictor filter 202 is the combined excitation signal ex(n), which is then filtered by a LP synthesis filter 203 to generate the reconstructed speech $\hat{s}(n)$. Note that for the case of multiple subframes in a frame, the LP synthesis filter 203 is typically $1/A_q(z)$ at the last subframe of the frame, and is derived from $A_q$ of the current and previous frames, for example, by interpolation, at the other subframes of the frame. The reconstructed speech $\hat{s}(n)$, is applied to an equalizer 204, which has as an additional input the quantized spectral (LP filter) coefficients $A_q$. The equalizer 204 generates the equalized reconstructed speech $\hat{s}eq(n)$. Note that the input to the equalizer 204 can be reconstructed speech which has been in addition processed by an adaptive spectral postfilter, such as described by Juin-Hwey Chen and Allen Gersho in a paper "Real-Time Vector APC Speech Coding at 4800 bps with Adaptive Postfiltering," published in the Proceedings of the International Conference on Acoustics, Speech, and Signal Processing, VOL. 4, pp. 2185-2188, Apr. 6-9, 1987. Alternately, an adaptive spectral postfilter can process the equalized reconstructed speech $\hat{s}_{eq}(n)$.

In yet another embodiment of the present invention, the adaptive spectral postfilter can be implemented within the equalizer block as will be described below.

The speech decoder 200 can be implemented using custom integrated circuits, FPGAs, PLAs, microcomputers with corresponding embedded firmware, microprocessor with preprogrammed ROMs or PROMs, and digital signal processors. Other types of custom integration can be utilized as well. The speech decoder 200 can also be implemented using computers, including but not limited to, desk top computers, laptop computers, servers, computer clusters, and the like. When implemented as custom integrated circuits, the CELP speech encoder can be utilized in communication devices such as cell phones.

Figure 3:
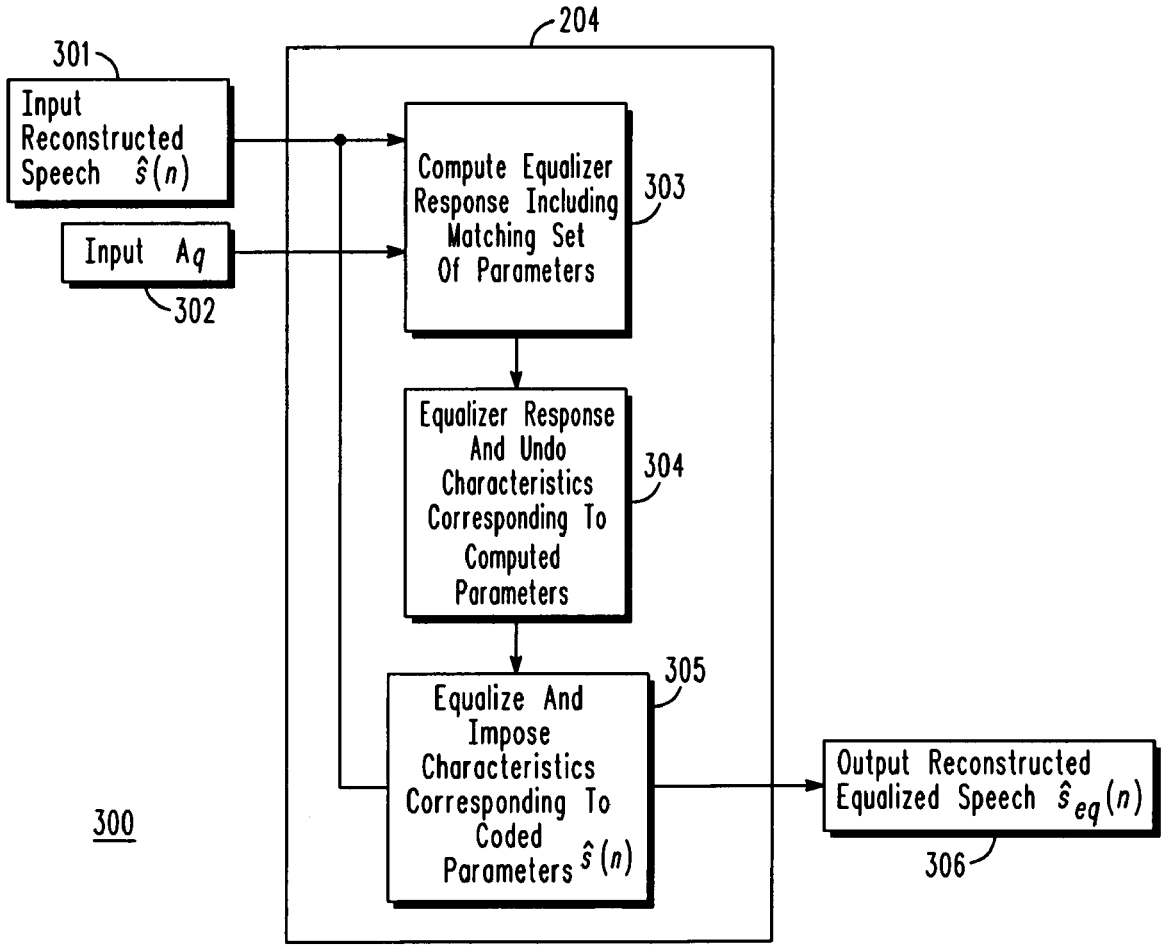
FIG. 3 is a flowchart depicting the operation of the equalizer 204.

FIG. 3 is a flowchart 300 describing the operation of the equalizer 204. The equalizer 204 operation is composed of two functional blocks shown as blocks 303 and 305. At block 303 the equalizer response is computed using the reconstructed speech signal $\hat{s}(n)$ and the quantized spectral coefficients $A_q$ and outputted at block 304. The equalizer response output at block 304 can be generated as a frequency-domain output shown at blocks 307 and 309 of FIG. 4 (suitable for use by a frequency-domain implementation at block 305), or as a time-domain output shown as blocks 308 and 310 of FIG. 4 (suitable for use by a time-domain implementation at block 305). In either case, the reconstructed speech signal $\hat{s}(n)$ is equalized at block 305, using the equalizer response generated to yield the reconstructed equalized speech $\hat{s}_{eq}(n)$.

Figure 4:
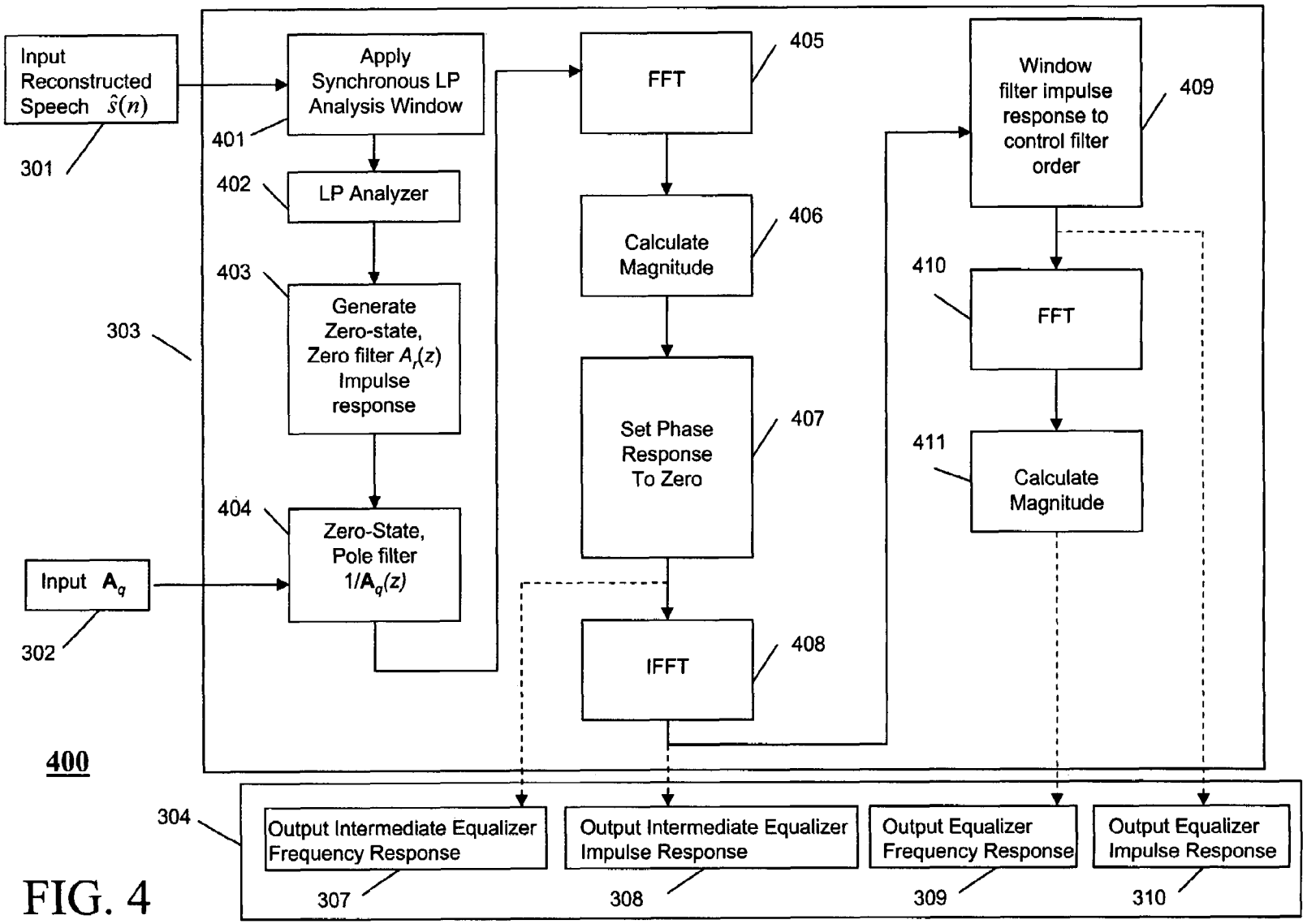
FIG. 4 is a flow chart depicting the computation of the equalizer response described in block 303.

The equalizer response outputted at block 304 is computed as shown in FIG. 4, which is a flowchart 400 depicting the computation of the equalizer response. Once a sufficient number of samples of the reconstructed speech signal $\hat{s}(n)$ has been generated at the speech decoder to permit synchronous windowing of the reconstructed speech (synchronous with respect to the window placement for the input speech being encoded), a segment of the reconstructed speech is synchronously windowed, block 401. The window used in block 401 is identical to the window used by the LP analysis windowing unit 101 used in the speech encoder 100, and furthermore has the property of perfect signal reconstruction when used for overlap-add synthesis, as will be described below, when the equalizer 204 is described. The windowed data is analyzed by an LP Analyzer, at block 402, to generate the spectral (LP) coefficients, $A_r$, corresponding to the windowed reconstructed speech. The LP analyzer used at block 402 and the LP analyzer 102 are identical, although different types of LP analysis may also be advantageously used. Next an impulse response of the LP inverse (zero) filter, defined by quantized spectral coefficients, $A_r$, is generated, at block 403. This can be accomplished by placing an impulse (1.0), followed sequentially by each of the $N_p$negated quantized spectral coefficients in an array, zero padded to 512 samples, where $N_p$ is the order of the LP filter used for the calculation of the equalizer response. In an embodiment of the present invention $N_p$is set to 10,and is equal the order P of the set of quantized spectral coefficients, $A_q$.Note that $N_p$ can be selected to be less than the order P of the set of quantized spectral coefficients $A_q$,in which case a reduced order (reduced to $N_p$ ) version of the filter $1/A_q(z)$ can be generated for the purpose of computing the equalizer response. The LP inverse filter response thus defined is then presented as an input to a zero-state pole filter, defined by the set of quantized spectral coefficients $A_q$or a set of quantized spectral coefficients corresponding to a reduced order version of the filter $1/A_q(z)$, and is filtered by the zero-state pole filter, at block 404. The resulting 512 sample sequence is transformed, via a 512 point Fast Fourier Transform (FFT), at block 405, into the frequency domain, and its magnitude spectrum is calculated, at block 406, as the equalizer magnitude response. The input to block 405 (and also to block 905, in FIG. 9 ) is referred to as the initial equalizer impulse response. At block 407, the phase response, corresponding to the frequency domain magnitude response derived at block 406, is set to zero. The effect is that the magnitude information is assigned to real components of the complex spectrum, and the imaginary parts of the complex spectrum are zero valued. Note that since this equalizer is defined as magnitude-only when applied, it has 0 phase, unlike the LP filters from which it was derived. This allows the original phase of the reconstructed windowed signal to be preserved, when that signal is equalized; a desirable characteristic. The output generated at block 407 is outputted as the Intermediate Equalizer Frequency Response, at block 307, which can be output, as shown in flowchart 400, bypassing blocks 408 through 411, when a reduced complexity equalizer response is desired. Otherwise, the Intermediate Equalizer Frequency Response generated at block 407, is transformed by a 512 point IFFT, at block 408, to generate a corresponding time domain impulse response, defined as the Intermediate Equalizer Impulse Response. When a reduced complexity equalizer response is desired and a time domain equalizer impulse response is the desired output, blocks 409 though 411 can be bypassed, and the output generated at block 408 is the Intermediate Equalizer Impulse Response that is outputted at block 308.

The zero phase equalizer frequency response (output generated at block 407) corresponds to a real symmetric impulse response in the time domain corresponding to the output generated at block 408. In order to avoid time domain aliasing in the equalized signal, the real symmetric impulse response in the time domain, output at block 408, is then rectangular windowed (although other windows can be used as well), at block 409, to limit and explicitly control the order of the symmetric time domain filter derived from the frequency domain equalizer information. The windowing should be such that the resulting impulse response is still symmetric. The resulting modified (i.e., order-reduced by windowing) filter impulse response, can then be outputted, at block 310, as the Equalizer Impulse Response, when a time domain response is the desired output and blocks 410 and 411 are bypassed in that case. When a frequency domain output is desired, the windowed real symmetric impulse response is then frequency transformed, by an FFT, at block 410, and the magnitude response is recalculated, at block 411. The output generated at block 411 is the Equalizer Frequency Response that is outputted at block 309. Note that four potential equalizer response outputs are generated as shown in flowchart 400. Depending on which output type is selected, usually at the algorithm design stage, the blocks performed using the flowchart 400 are configured to eliminate unused blocks within the flowchart 400 as outlined.

The explicit control of the filter order for the time domain representation of the equalizer, allows the algorithm developer to select the maximum allowable length of "sample tails.""Sample tails" are the extra non-zero samples in the windowed signal after signal modification, which can be generated by the equalization procedure, at block 204 and, when present, extend beyond the original analysis window boundaries. Using the above method to ensure that the maximum possible "sample tail" length on each side of the analysis window is 128,the overlap-add synthesis procedure has been modified to account for-by adding-each of the two 128 sample "sample tails"when generating the modified reconstructed speech. The "sample tails" length of 128 implies that a 256 sample rectangular window is applied to the filter impulse response, at block 409.

The function of the Equalizer, described in flow chart 300, is to undo a set of characteristics, calculated from the reconstructed speech, and impose a desired set of coded characteristics onto the reconstructed speech, thus generating the equalized reconstructed speech. As previously described above, the set of characteristics calculated from the reconstructed speech is modeled by $A_r(z)$ and the desired set of coded characteristics is modeled by $A_q(z)$, where $1/A_q(z)$ represents the quantized version of the spectral envelope computed from the input speech. A set of desired characteristics that is based on $A_q(z)$, for example, can include an adaptive spectral postfilter as part of the equalizer. To that end the zero-state pole filter $$\frac{1}{A_q(z)}$$

described at block 404 can be replaced by a cascade of zero-state filters, for example:

$$\frac{1}{A_q(z)} A_q\left(\frac{z}{\lambda_1}\right) \frac{1}{A_q\left(\frac{z}{\lambda_2}\right)} (1 - \mu z^{-1}), \quad \text{where } 0 < \lambda_1 < \lambda_2 < 1$$

where $\lambda_1$=0.5 and $\lambda_2$=0.8 are typical values for parameters $\lambda_1$ and $\lambda_2$, although other values can also be advantageously used. Moreover $\lambda_1$ and $\lambda_2$ can be adaptively varied, for example, based on $A_q(z)$. The range of $\mu$ is given by $0 \leqq \mu < 1$, with a representative value for $\mu$, if non-zero, being 0.2.

Another way of combining the equalizer with an adaptive spectral postfilter is to not replace the zero-state pole filter by a cascade of zero-state filters, at block 404 as previously described, but to modify the equalizer magnitude response generated at block 406 instead. In that case, the magnitudes calculated at block 406 can be raised to a power greater than 1, thereby increasing the dynamic range. This may cause the spectral tilt inherent in the magnitude spectrum to change, which is an undesirable side effect. Using the technique of linear regression, the spectral tilt of the original magnitudes can be imposed on the modified magnitudes.

Figure 5:
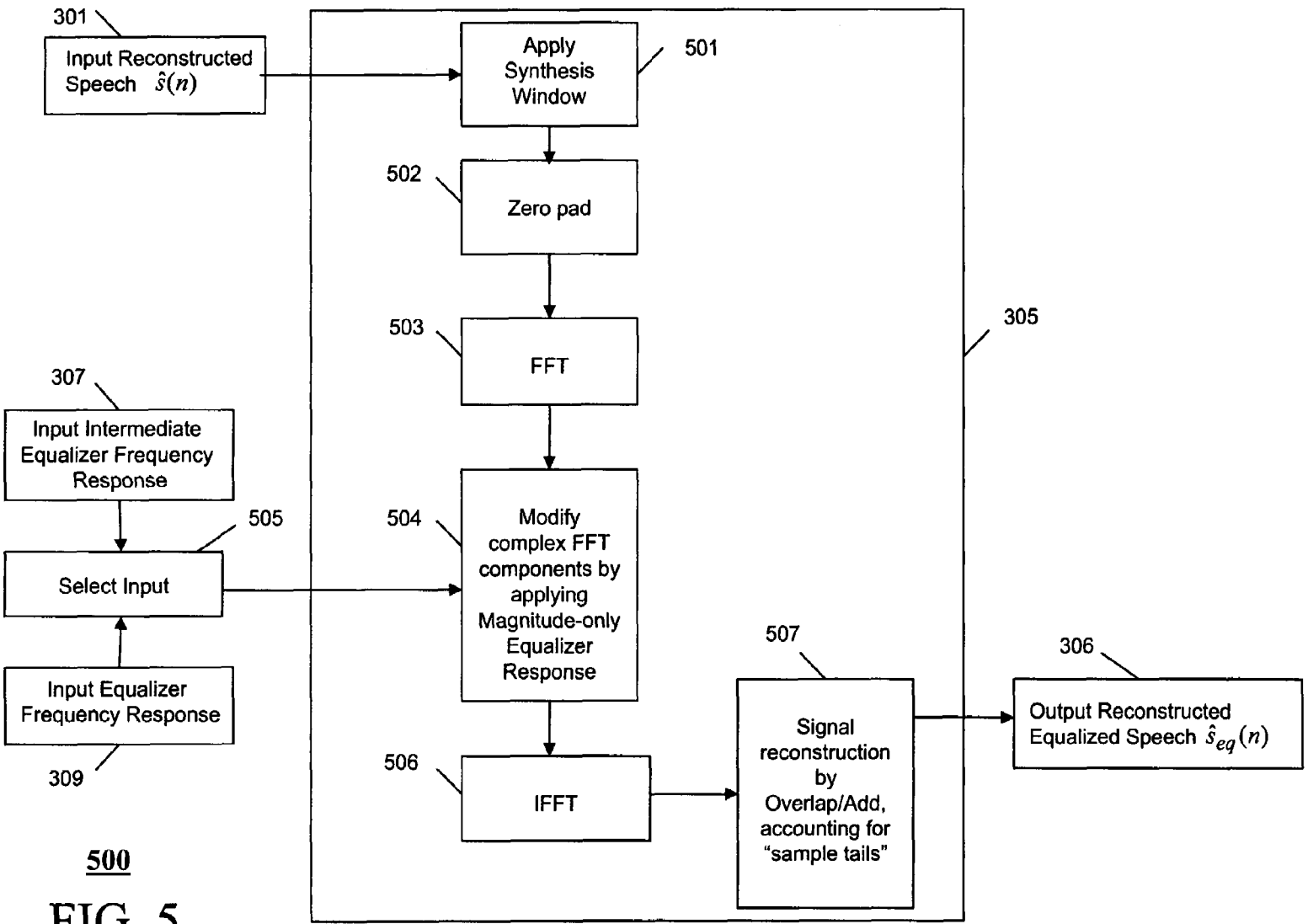
FIG. 5 is a flowchart depicting an implementation of an equalizer 305.
Figure 6:
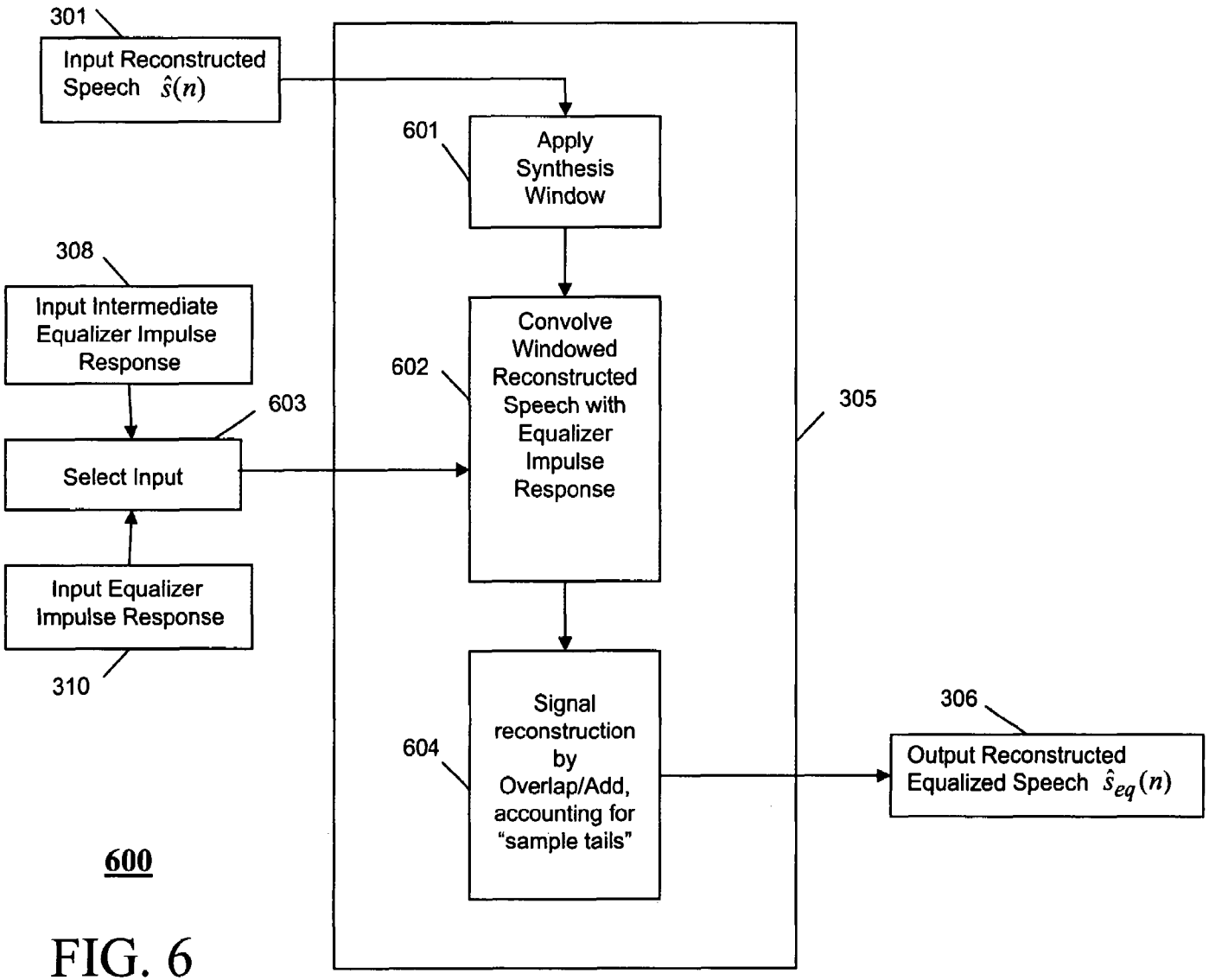
FIG. 6 is a flowchart depicting an alternate implementation of the equalizer 305.

The Equalizer Response, generated at block 303 (and shown in more detail in flowchart 400), is provided as an input to block 305. The Equalizer Response outputted at block 304 can be a frequency domain equalizer frequency response or a time domain equalizer impulse response, depending on which output type was selected for flowchart 400, as described above. FIGS. 5 and 6 illustrate the frequency domain implementation and the time domain implementation of block 305, respectively.

FIG. 5 is a flowchart 500 depicting the frequency-domain equalizer implementation. The reconstructed speech $\hat{s}(n)$ input at block 301 is windowed by a synthesis window, at block 501. In an embodiment, of the present invention, block 501 is identical to block 401, and the outputs generated by the two blocks are identical. Thus it is possible to reuse the output generated at block 401 as an output for block 501, thereby eliminating duplication of computations. However, to allow for a possibility of using non-identical widows for blocks 401 and 501, each block is shown individually. The windowed reconstructed speech is zero padded to 512 samples, at block 502, and transformed by an FFT, at block 503, to yield complex spectral coefficients. Since the input provided at block 503 is a real signal, the complex spectral coefficient at any negative frequency is a complex conjugate of the complex spectral coefficient at a corresponding positive frequency. This property can be exploited to potentially reduce the modification complexity, by explicitly modifying, at block 504, only the complex spectral coefficients for positive frequencies, and copying a complex conjugated version of each modified spectral coefficient to its corresponding negative frequency location. The frequency domain equalization is performed at block 504, which modifies the complex spectral coefficients generated at block 502, as a function of the Equalizer Response, which is also the input at block 504. The Equalizer Response output at block 304 is selected, at block 506, from either the Intermediate Equalizer Frequency Response outputted at block 307 or the Equalizer Frequency Response outputted at block 309. In either case, the Equalizer Response is a magnitude-only, zero phase frequency response. The block of modifying the complex spectral coefficients consists of multiplying each complex spectral coefficient by the Equalizer Response at the corresponding frequency. Other mathematically equivalent ways of implementing the modification can also be used. For example, when log transformation of the magnitude spectrum is used, the multiplication block described above would be replaced by an addition block, assuming that the Equalizer Response is equivalently transformed. The modified complex spectral coefficients generated at block 504, are transformed to the time domain, by an IFFT, at block 505. When desired, the energy in the modified reconstructed windowed speech can be normalized to be equal to the energy in the reconstructed windowed speech. In this case, the energy normalization factor is computed over the full frequency band. Alternately it can also be calculated over a reduced frequency range within the full band, and then applied to the modified reconstructed windowed speech. Note that other types of automated gain control (AGC) can be advantageously used instead. Although the windowed reconstructed speech is 256 samples long, the modified reconstructed speech can contain non-zero values which extend beyond the original window boundaries; i.e., "sample tails." When the equalizer filter impulse response is windowed, to control filter order, at block 409, the maximum length of "samples tails" is known. In an embodiment of the present invention, that length is selected to be 128 samples long, and the overlap-add signal reconstruction, at block 507, has been modified to account for the presence of the "sample tails." The modification consists of redefining the reconstruction window length from the original 256 sample length to 512 samples, by including the "sample tails" before and after the boundaries of the analysis window used. The original 128 sample window shift, for advancing consecutive synthesis windows, is maintained. The reconstructed equalized speech $\hat{s}_{eq}(n)$ is the output of flowchart 500.

Alternately, block 305 can be implemented in the time domain, as shown in FIG. 6. FIG. 6 is a flowchart 600 depicting the time-domain equalizer implementation. The reconstructed speech $\hat{s}(n)$ inputted at block 301 is windowed by a synthesis window, at block 601. In an embodiment of the present invention, block 601 is identical to block 401, and the outputs of the two blocks are identical. Thus it is possible to reuse the output generated at block 401 as an output generated at block 601, thereby eliminating duplication of computations. However, to allow for a possibility of using non-identical widows in blocks 401 and 601, each block is shown individually. The windowed reconstructed speech is then convolved with the time domain equalizer impulse response (Equalizer Response), at block 602. The time domain equalizer impulse response provided at block 602 is selected at block 603 as either the Intermediate Equalizer Impulse Response outputted at block 308 or the Equalizer Impulse Response outputted at block 310, depending on which output type was selected by flowchart 400, as described above. The output generated at block 602 is the modified reconstructed windowed speech, which is used to generate the reconstructed equalized speech $\hat{s}_{eq}(n)$, at block 603, via the overlap-add signal reconstruction, at block 604, modified to account for "sample tails" as previously described. When desired, the energy in the equalized reconstructed windowed speech can be normalized to be equal to the energy in the reconstructed windowed speech, prior to the overlap-add signal reconstruction. Other types of automated gain control (AGC) can be advantageously used instead. Note that block 603 is identical to block 506, of FIG. 5. While the selection of the desired equalizer response is shown at blocks 505 and 603 in flowcharts 500 and 600, respectively, it will be appreciated that only one of the four potential equalizer response outputs generated, as shown in flowchart 400, is selected. The selection is made at the algorithm design stage, and the blocks performed, using flowchart 400, are configured to eliminate unused blocks within the flowchart 400 as outlined above.

FIGS. 3 through 6, are flow charts describing the blocks by which the speech decoder 200 equalizes the reconstructed speech from information received from a speech encoder, such as speech encoder 100. One of ordinary skill in the art will appreciate that the speech equalization process described in FIGS. 3 through 6 can be implemented as corresponding hardware elements, using technologies such as described for the speech decoder 200 above.

Alternately the equalizer can operate on the combined excitation ex(n), instead of the reconstructed speech $\hat{s}(n)$ previously illustrated in FIGS. 2-6. This alternate configuration of he equalizer is shown in FIGS. 7-11, which are largely similar to the corresponding FIGS. 2-6. Where differences arise, those will be pointed out.

Figure 7:
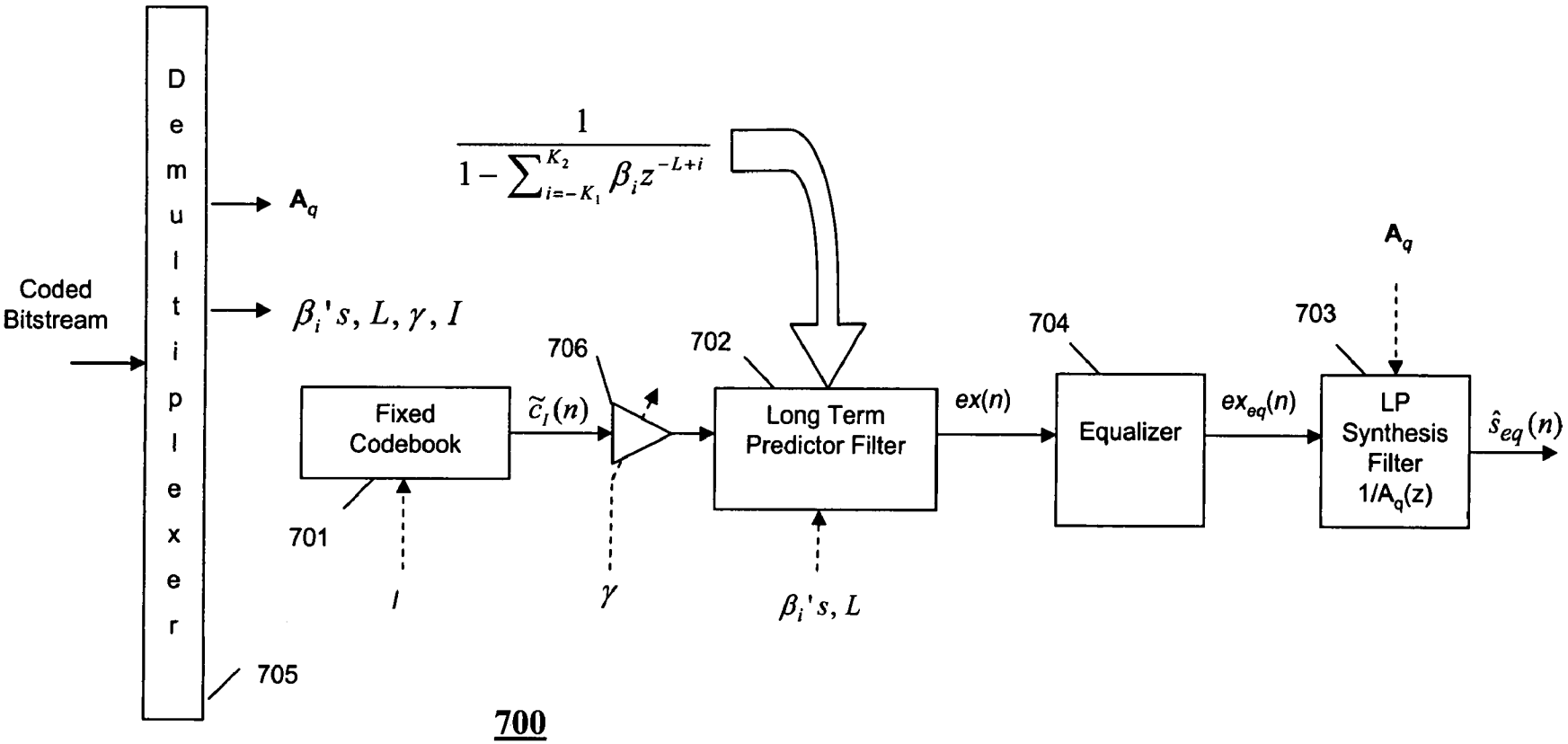
FIG. 7 is a block diagram of an alternate configuration speech decoder 700 employing an alternate configuration equalizer 704.

FIG. 7 is a block diagram of a speech decoder 700, employing an alternate equalizer configuration. FIG. 7 is identical to FIG. 2, but for the following exceptions: the Equalizer 704, has been moved to precede the LP Synthesis Filter 703. Note also that the LP synthesis filter 703 can optionally include an adaptive spectral postfilter stage. The Equalizer 704, has been modified to accept only one input signal, which is the combined excitation ex(n), unlike the Equalizer 204, described in FIG. 2, which has as inputs the quantized spectral coefficients $A_q$ and the reconstructed speech $\hat{s}(n)$. The output of the Equalizer, 704, is the equalized combined excitation, $ex_{eq}(n)$, which is applied to the LP Synthesis Filter 703, to produce the equalized reconstructed speech $\hat{s}_{eq}(n)$.

The speech decoder 700, can be implemented using custom integrated circuits, FPGAs, PLAs, microcomputers with corresponding embedded firmware, microprocessor with preprogrammed ROMs or PROMs, and digital signal processors. Other types of custom integration can be utilized as well. The speech decoder 700 can also be implemented using computers, including but not limited to, desk top computers, laptop computers, servers, computer clusters, and the like. When implemented as custom integrated circuits, the CELP speech encoder can be utilized in communication devices such as cell phones.

Figure 8:
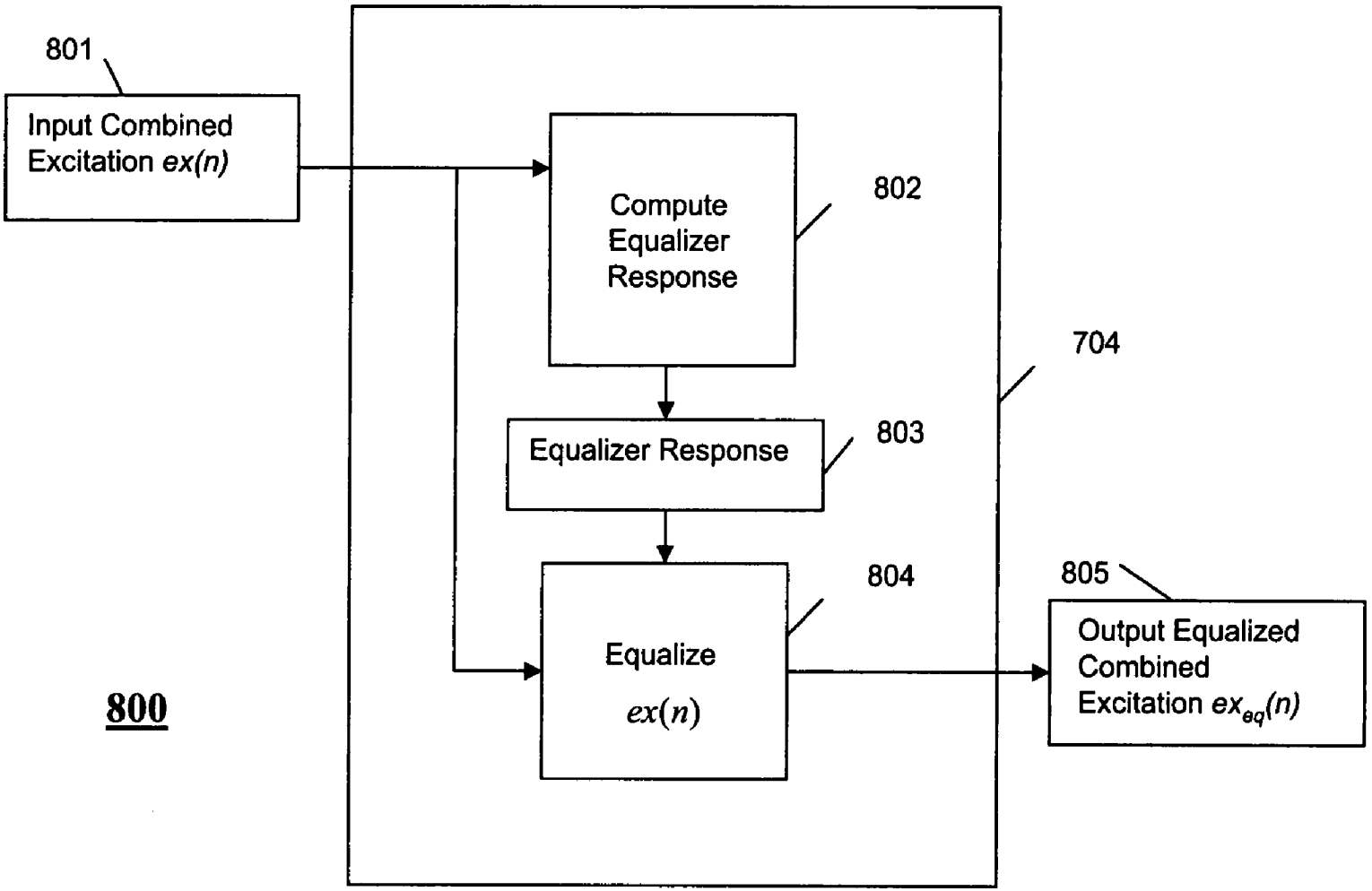
FIG. 8 is a flowchart depicting the alternate configuration equalizer 704.

FIG. 8 is a flowchart 800 showing the operation of the equalizer 704. The Compute Equalizer Response, at block 802, differs from the corresponding block 303, in that the input is the combined excitation ex(n), instead of the reconstructed speech $\hat{s}(n)$, and lacks the quantized spectral coefficients $A_q$ as a second input. Block 802 is functionally identical to block 303, except that the Equalizer Response provided is based on a different input, and is computed differently, as the signal being equalized is the combined excitation ex(n) instead of the reconstructed speech $\hat{s}(n)$.

Figure 9:
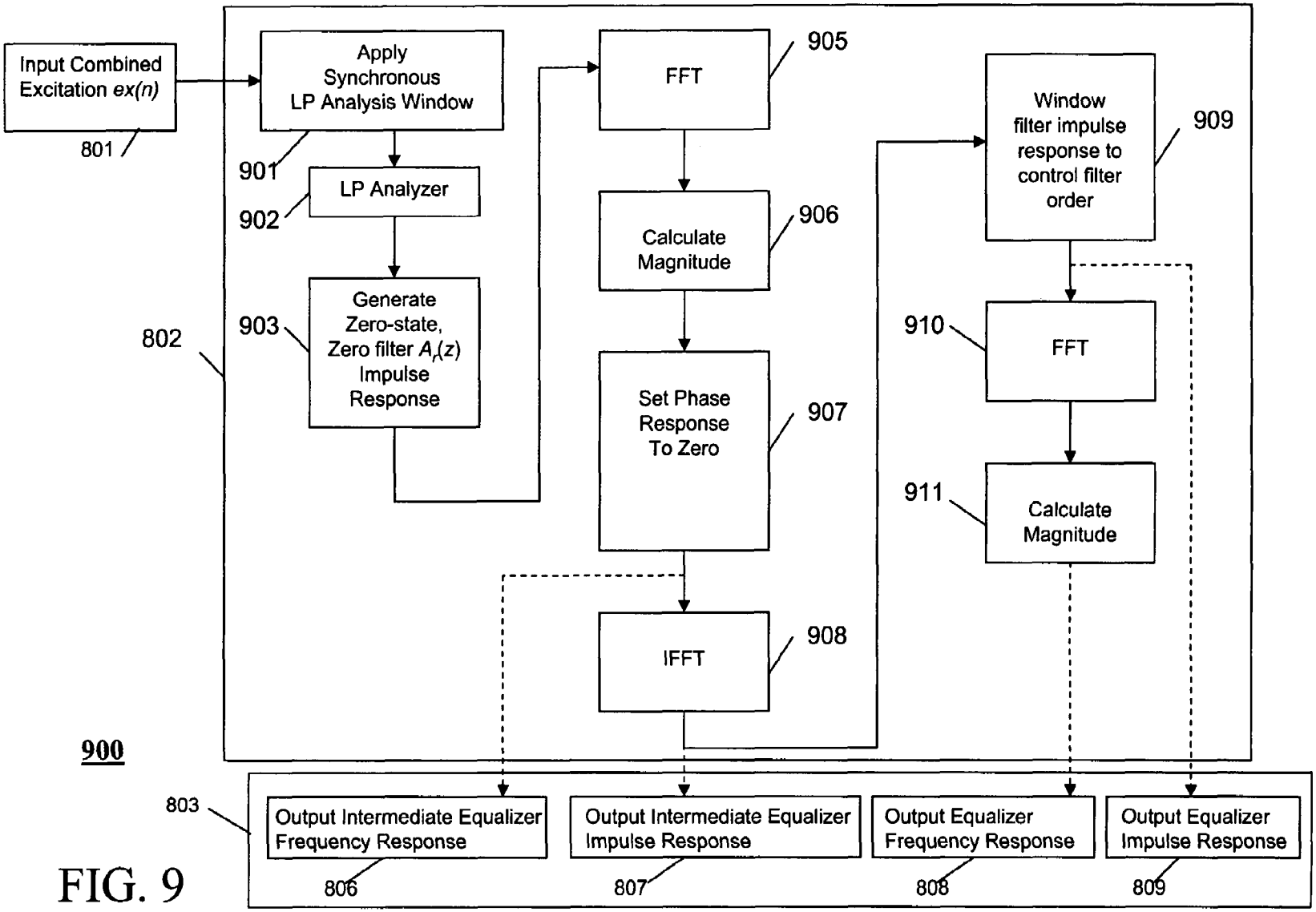
FIG. 9 is a flow chart depicting the computation of the equalizer response of the alternate configuration equalizer 704 described in block 802.

FIG. 9 is a flowchart 900 showing the blocks for computing the Equalizer Response described for block 802. FIG. 9 is identical to FIG. 4, except that there is only one input, which is the combined excitation ex(n). Since the other input, $A_q$, is not provided, the block equivalent to block 302 which uses $A_q(z)$, is not required.

Figure 10:
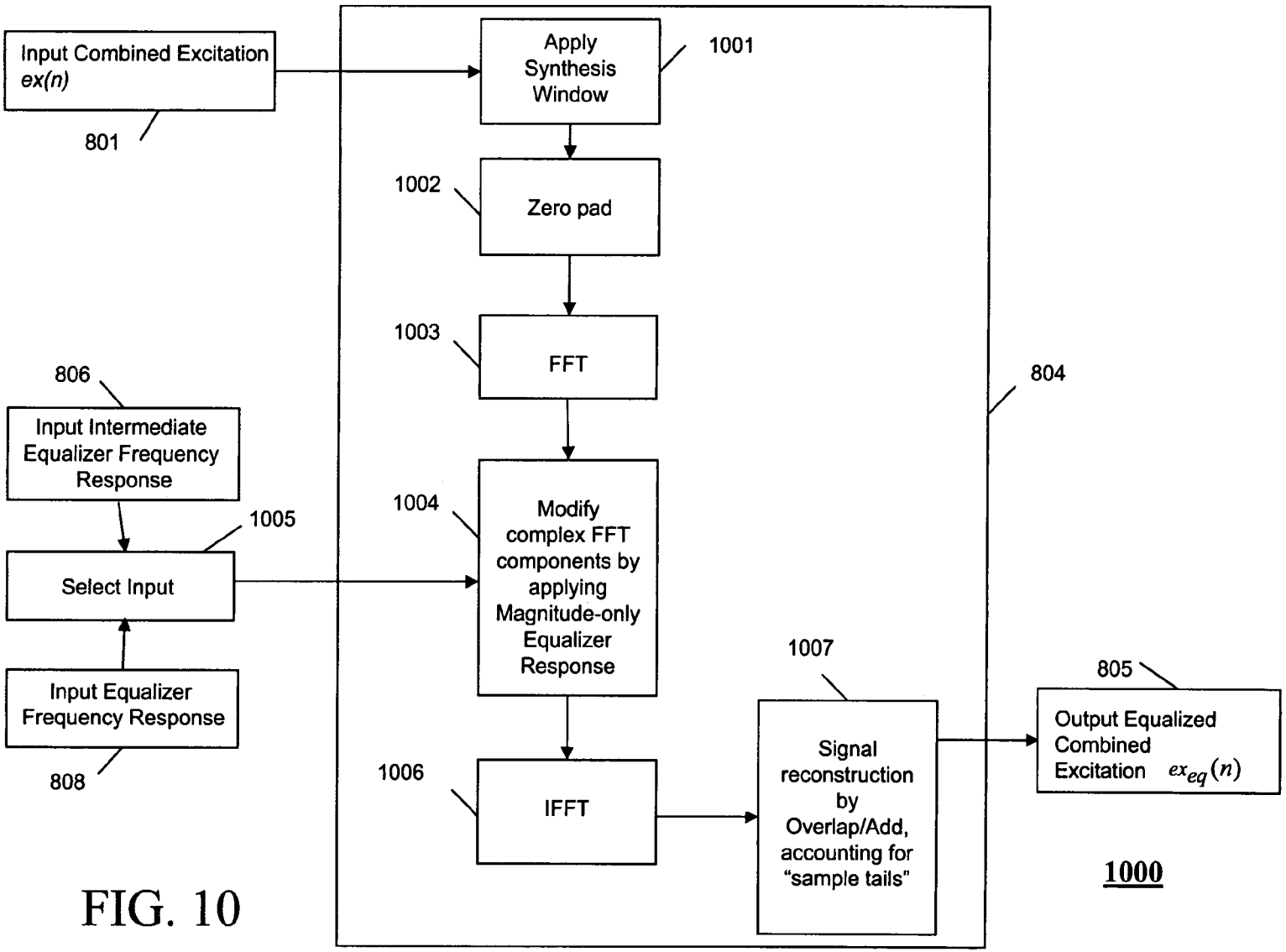
FIG. 10 is a flowchart depicting an implementation of the alternate configuration equalizer 804.
Figure 11:
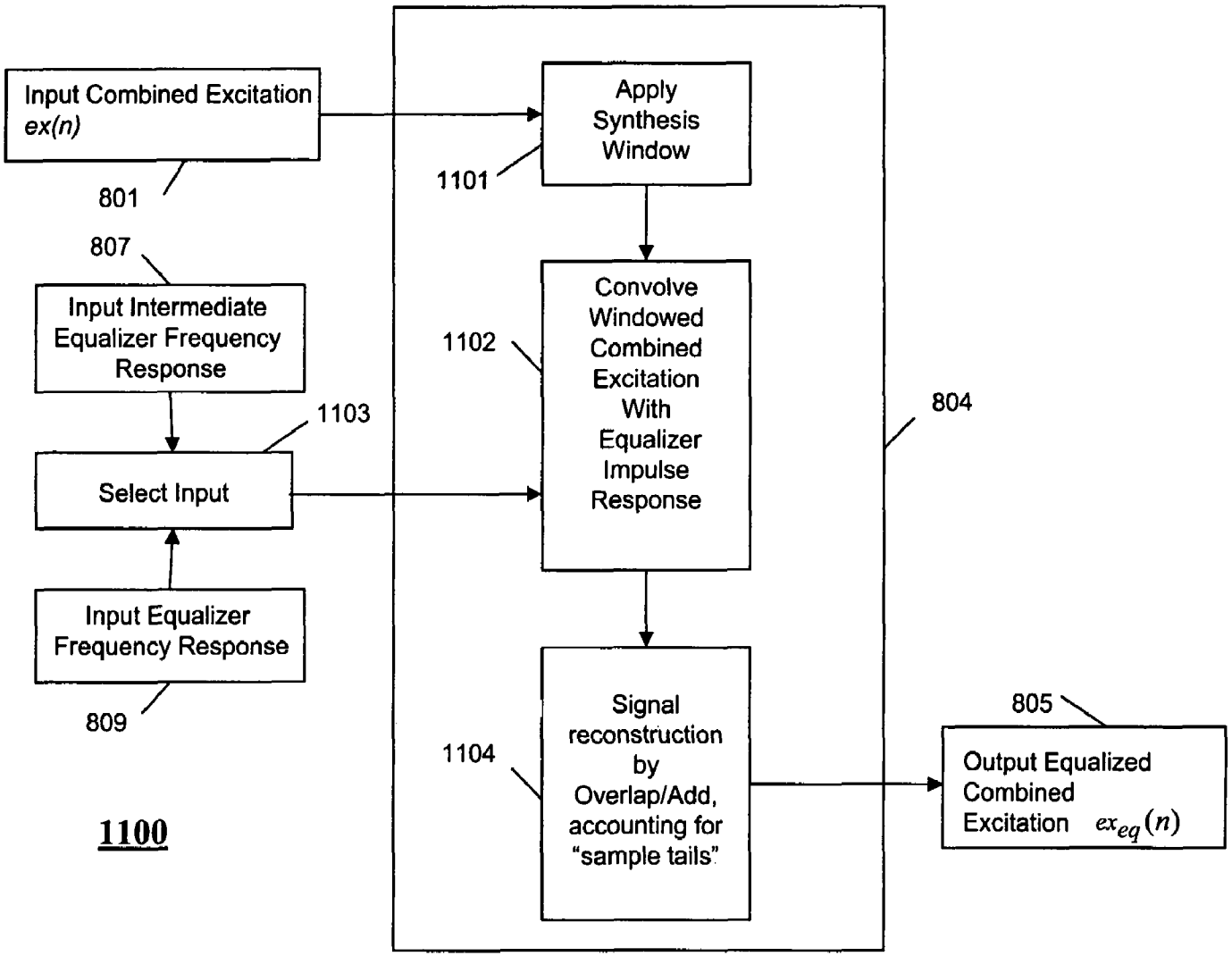
FIG. 11 is a flow chart depicting an alternate implementation of the alternate configuration equalizer 804.

FIG. 10 is a flow chart that is identical to the flow chart of FIG. 5 except that the computation is based on the combined excitation ex(n), instead of the reconstructed speech $\hat{s}(n)$. The output that is generated is the equalized combined excitation $ex_{eq}(n)$, instead of the equalized reconstructed speech $\hat{s}_{eq}(n)$. Similar comments apply to the flowchart of FIG. 11 and the flow chart of FIG. 6.

This technique can be integrated into a low-bit rate speech encoding algorithm. The integration issues include selecting an LP analysis window and an LP coding rate such that those design decisions maintain synchrony between the windowing of the input target speech and of the reconstructed speech, while allowing perfect signal reconstruction via the overlap-add technique. Given 50% overlap as the desired target for overlap-add synthesis, a 256 sample long LP analysis window is used, centered at the $2^{nd}$ of the two subframes of a 128 sample frame, with each subframe spanning 64 samples. Other algorithm configurations are possible. For example, the frame can be lengthened to 256 samples and partitioned into four subframes. To maintain the goal of 50% overlap for the overlap-add block, two sets of LP coefficients can be explicitly transmitted, a first set corresponding to a 256 sample LP analysis window centered at the $2^{nd}$ of the four subframes, and a $2^{nd}$ set corresponding to the 256 sample LP analysis window centered at the $4^{th}$ of the four subframes. Each LP parameter set can be quantized independently, or the two sets of the LP parameters can be matrix quantized together, as for example in the "Enhanced Full Rate (EFR) speech transcoding; (GSM 06.60 version 8.0.1 Release 1999)." Alternately, the $2^{nd}$ of the two LP parameter sets can be explicitly quantized, with the $1^{st}$ set of LP coefficients being reconstructed as a function of the $2^{nd}$ set of LP parameters for the current frame, and $2^{nd}$ set of LP parameters from the previous frame, for example by use of interpolation. The interpolation parameter or parameters can be explicitly quantized and transmitted, or implicitly inferred. Other analysis windows, which have perfect reconstruction property but reduced amount of overlap, thus allowing a single set of coded LP parameters per frame, can also be used. Applying the equalization to contiguous (non-overlapping) signal blocks is also possible, but care must be taken in that case to prevent creation of blocking artifacts, which may arise as a consequence of performing adaptive equalization updated at a block rate, without any overlap, except that due to the blocks taken to account for the "sample tails."

The set of coded characteristic parameters to be used for generating the equalizer response needs to be quantized with sufficient resolution to be perceptually transparent. This is because the attributes associated with the coded characteristic parameters will be imposed on the reconstructed speech by the equalization procedure. Note that the requirement of high resolution quantization can be slightly relaxed, by applying smoothing to the set of coded characteristic parameters, and to the set of characteristic parameters computed from the reconstructed speech, prior to the computation of the Equalizer Response. For example, the smoothing can be implemented by applying a small amount of bandwidth expansion to each of the two LP filters that are used to compute the equalizer response. This entails using $$A_q\left(\frac{z}{\alpha_1}\right),\ 0 \le \alpha_1 < 1$$

instead of $A_q(z)$ in block 404, and $$A_r\left(\frac{z}{\alpha_2}\right),\ 0 \le \alpha_2 < 1$$

instead of $A_q(z)$ in block 403. Typically $\alpha_1=\alpha_2\cong 1$ would be selected, for example, $\alpha_1=\alpha_2=0.98$. The degree of smoothing, when smoothing is employed, is dependent on the resolution with which the LP filter coefficients $A_q(z)$ are quantized. Alternately, the Equalizer Response can be smoothed after it has been computed. Other means for relaxing the resolution for encoding the characteristic parameters may be formulated, without departing from the scope and the spirit of the present invention.

While the selection of the desired equalizer response is shown at blocks 1005 and 1103, respectively, in flowcharts 1000 and 1100, it will be appreciated that only one of the four potential equalizer response outputs generated as shown in flowchart 900 is selected. The selection is at the algorithm design stage, and the blocks performed using the flowchart 900 are configured to eliminate unused blocks within the flowchart 900 as outlined for flowchart 400 above.

FIGS. 8 through 11, are flow charts describing the blocks by which the speech decoder 700 equalizes the combined excitation from information received from a speech encoder, such as speech encoder 100. One of ordinary skill in the art will appreciate that the equalization process described in FIGS. 8 through 11 can be implemented as corresponding hardware elements, using technologies such as described for the speech decoder 700 above.

An equalizer for enhancing the quality of a speech coding system is described above. The equalizer makes use of a set of coded parameters, e.g., short-term predictor parameters, that is normally transmitted from the speeder encoder to the speech decoder. The equalizer also computes a matching set of parameters from the reconstructed speech, generated by the decoder. The function of the equalizer is to undo the set of computed characteristics from the reconstructed speech, and impose onto the reconstructed speech the set of desired signal characteristics represented by set of coded parameters transmitted by the encoder, thus producing equalized reconstructed speech. Enhanced speech quality is thus achieved with no additional information being transmitted from the encoder.

The equalized framework described above, is applicable to speech enhancement problems outside of speed coding.

We claim:

1. A speech communication system, comprising:

a speech decoder that receives a set of coded parameters representative of the desired signal characteristics without explicit quantization and transmission of information about an equalizer response and inputting quantized, and uses the set of coded parameters and the inputting quantized spectral coefficients to generate reconstructed speech, said speech decoder comprising an equalizer that computes equalizer response including a matching set of speech coder parameters from the reconstructed speech that match speech coder parameters that were quantized by a speech encoder before the speech encoder transmitted the set of coded parameters representative of the desired signal characteristics to the speech decoder, undoes the set of characteristics corresponding to the computed set of speech coder parameters, and imposes the set of characteristics corresponding to the coded set of speech coder parameters, thereby producing equalized reconstructed speech.

2. The speech communication system of claim 1, wherein the set of coded parameters representative of the desired signal characteristics is the set of spectral coefficients.

3. The speech communication system of claim 2, wherein the spectral coefficients are linear prediction (LP) coefficients for a short-term filter.

4. The speech communication system according to claim 1, wherein the speech decoder further comprising:

a demultiplexer that demultiplexes a received coded bitstream to recover therefrom quantized spectral (LP) coefficients and excitation parameters corresponding to a frame in a sequence of speech frames, the excitation parameters comprising a codevector index, a scale factor, long term predictor filter coefficients and a delay value;

a codebook that stores a plurality of codebook codevectors with each of the plurality of codebook codevectors associated with an index for generating a codebook codevector in response to the recovered codevector index;

a long-term predictor filter that processes the codebook codevector using the long term predictor filter coefficients and the delay value recovered for the frame in the sequence of speech frames to generate a combined excitation signal; and an LP synthesis filter that processes the combined excitation signal using the recovered quantized spectral coefficients to generate a reconstructed speech signal corresponding to the frame in the sequence of speech frames.

5. The speech communication system according to claim 4, wherein the excitation parameters further comprise a scale factor, and wherein the speech decoder further comprises:

a gain controller, coupled to said codebook and responsive to the recovered scale factor, for generating a scaled codebook codevector; and said long-term predictor filter processes the scaled codebook codevector using the long term predictor filter coefficients and the delay value recovered for the frame in the sequence of speech frames to generate a combined excitation signal.

6. The speech communication system according to claim 1, wherein said equalizer computes from the reconstructed speech signal and quantized spectral coefficients recovered from a received coded bitstream an equalizer response, the equalizer response being used to generate the equalized reconstructed speech.

7. The speech communication system according to claim 6, wherein said equalizer computes the equalizer response by applying an LP analysis window to the reconstructed speech signal to generate a windowed reconstructed speech signal, analyzing the windowed reconstructed speech signal using LP analysis to derive therefrom spectral (LP) coefficients, generating an impulse response using a zero-state zero filter response defined by the derived spectral (LP) coefficients, filtering the impulse response using a zero-state pole filter response defined by the recovered quantized spectral coefficients to generate an initial equalizer impulse response, transforming the initial equalizer impulse response using a Fast Fourier Transform into a frequency domain signal, calculating the magnitude spectrum of the frequency domain signal, using the magnitude spectrum as the equalizer magnitude response, setting the equalizer phase response to zero to generate an intermediate equalizer frequency response, and outputting the intermediate equalizer frequency response.

8. The speech communication system according to claim 7, wherein said equalizer further computes the equalizer response by transforming the intermediate equalizer frequency response into an intermediate equalizer impulse response using an Inverse Fast Fourier Transform, and outputting the intermediate equalizer impulse response.

9. The speech communication system according to claim 8, wherein a reconstructed speech signal is equalized by applying a synthesis window to the reconstructed speech signal to generate a windowed reconstructed speech frame in a sequence of reconstructed speech frames, convolving the windowed reconstructed speech frame using the intermediate equalizer impulse response to generate a modified windowed reconstructed speech frame, generating the equalized reconstructed speech signal using an overlap/adder on adjacent modified windowed reconstructed speech frames, and outputting the equalized reconstructed speech signal.

10. The speech communication system according to claim 8, wherein said equalizer further computes the equalizer response by windowing the intermediate equalizer impulse response using a symmetric window to generate an equalizer impulse response, and outputting the equalizer impulse response.

11. The speech communication system according to claim 10, wherein a reconstructed speech signal is equalized by applying a synthesis window to the reconstructed speech signal to generate a windowed reconstructed speech frame in a sequence of reconstructed speech frames, convolving the windowed reconstructed speech frame using the equalizer impulse response to generate a modified windowed reconstructed speech frame, generating the equalized reconstructed speech signal using an overlap/adder on adjacent modified windowed reconstructed speech frames, and outputting the equalized reconstructed speech signal.

12. The speech communication system according to claim 10 wherein said equalizer further computes the equalizer response by transforming the equalizer impulse response using a Fast Fourier Transform into an equalizer frequency response, and outputting the equalizer frequency response.

13. The speech communication system according to claim 12, wherein a reconstructed speech signal is equalized by applying a synthesis window to the reconstructed speech signal to generate a windowed reconstructed speech frame in a sequence of reconstructed speech frames, zero padding the windowed reconstructed speech frame to generate a zero-padded windowed reconstructed speech frame, transforming the zero-padded windowed reconstructed speech frame using a Fast Fourier Transform to generate complex spectral coefficients, modifying the complex spectral coefficients by applying the equalizer frequency response to generate modified complex spectral coefficients, transforming the modified complex spectral coefficients using an Inverse Fast Fourier Transform to generate a modified windowed reconstructed speech frame, generating the equalized reconstructed speech signal using an overlap/adder on adjacent modified windowed reconstructed speech frames, and outputting the equalized reconstructed speech signal.

14. The speech communication system according to claim 6, wherein a reconstructed speech signal is equalized by applying a synthesis window to the reconstructed speech signal to generate a windowed reconstructed speech frame in a sequence of reconstructed speech frames, zero padding the windowed reconstructed speech frame to generate a zero-padded windowed reconstructed speech frame, transforming the zero-padded windowed reconstructed speech frame using a Fast Fourier Transform to generate complex spectral coefficients, modifying the complex spectral coefficients by applying the intermediate equalizer frequency response to generate modified complex spectral coefficients, transforming the modified complex spectral coefficients using an Inverse Fast Fourier Transform to generate a modified windowed reconstructed speech frame, generating the equalized reconstructed speech signal using an overlap/adder on adjacent modified windowed reconstructed speech frames, and outputting the equalized reconstructed speech signal.

15. A method by which an equalizer equalizes a reconstructed speech signal without explicit quantization and transmission of information about an equalizer response, the method comprising the steps of:

inputting the reconstructed speech signal inputting quantized spectral coefficients, computing equalizer response including a set of speech coder parameters from the reconstructed speech that match speech coder parameters that were quantized by a speech encoder before the speech encoder transmitted the set of coded parameters representative of the desired signal characteristics to the speech decoder, undoing the set of characteristics corresponding to the computed set of speech coder parameters, and imposing the set of characteristics corresponding to the coded set of speech coder parameters, thereby generating equalized reconstructed speech from the reconstructed speech signal and the quantized spectral coefficients.

16. The method according to claim 15, further comprising the steps of:

applying an LP analysis window to the reconstructed speech signal to generate a windowed reconstructed speech signal, analyzing the windowed reconstructed speech signal using LP analysis to derive therefrom spectral (LP) coefficients, generating an impulse response using a zero-state zero filter response defined by the derived spectral (LP) coefficients, filtering the impulse response using a zero-state pole filter response defined by the recovered quantized spectral coefficients to generate an initial equalizer impulse response, transforming the initial equalizer impulse response using a Fast Fourier Transform into a frequency domain signal, calculating the magnitude spectrum of the frequency domain signal, using the magnitude spectrum as the equalizer magnitude response, setting the equalizer phase response to zero to generate an intermediate equalizer frequency response, and outputting the intermediate equalizer frequency response.

17. The method according to claim 16, further comprising:

transforming the intermediate equalizer frequency response into an intermediate equalizer impulse response using an Inverse Fast Fourier Transform, and outputting the intermediate equalizer impulse response.

18. The method according to claim 17, further comprising:

applying a synthesis window to the reconstructed speech signal to generate a windowed reconstructed speech frame in a sequence of reconstructed speech frames, convolving the windowed reconstructed speech frame using the intermediate equalizer impulse response to generate a modified windowed reconstructed speech frame, generating the equalized reconstructed speech signal using an overlap/adder on adjacent modified windowed reconstructed speech frames, and outputting the equalized reconstructed speech signal.

19. The method according to claim 17, further comprising:

windowing the intermediate equalizer impulse response using a symmetric window to generate an equalizer impulse response, and outputting the equalizer impulse response.

20. The method according to claim 19, further comprising:

applying a synthesis window to the reconstructed speech signal to generate a windowed reconstructed speech frame in a sequence of reconstructed speech frames, convolving the windowed reconstructed speech frame using the equalizer impulse response to generate a modified windowed reconstructed speech frame, generating the equalized reconstructed speech signal using an overlap/adder on adjacent modified windowed reconstructed speech frames, and outputting the equalized reconstructed speech signal.

21. The method according to claim 19, further comprising:

transforming the equalizer impulse response using a Fast Fourier Transform into an equalizer frequency response, and outputting the equalizer frequency response.

22. The method according to claim 21, further comprising:

applying a synthesis window to the reconstructed speech signal to generate a windowed reconstructed speech frame in a sequence of reconstructed speech frames, zero padding the windowed reconstructed speech frame to generate a zero-padded windowed reconstructed speech frame, transforming the zero-padded windowed reconstructed speech frame using a Fast Fourier Transform to generate complex spectral coefficients, modifying the complex spectral coefficients by applying the equalizer frequency response to generate modified complex spectral coefficients, transforming the modified complex spectral coefficients using an Inverse Fast Fourier Transform to generate a modified windowed reconstructed speech frame, generating the equalized reconstructed speech signal using an overlap/adder on adjacent modified windowed reconstructed speech frames, and outputting the equalized reconstructed speech signal.

23. The method according to claim 15, further comprising:

applying a synthesis window to the reconstructed speech signal to generate a windowed reconstructed speech frame in a sequence of reconstructed speech frames, zero padding the windowed reconstructed speech frame to generate a zero-padded windowed reconstructed speech frame, transforming the zero-padded windowed reconstructed speech frame using a Fast Fourier Transform to generate complex spectral coefficients, modifying the complex spectral coefficients by applying the intermediate equalizer frequency response to generate modified complex spectral coefficients, transforming the modified complex spectral coefficients using an Inverse Fast Fourier Transform to generate a modified windowed reconstructed speech frame, generating the equalized reconstructed speech signal using an overlap/adder on adjacent modified windowed reconstructed speech frames, and outputting the equalized reconstructed speech signal.

* * * * *